US006916130B1

(12) United States Patent
Holt et al.

(10) Patent No.: US 6,916,130 B1
(45) Date of Patent: Jul. 12, 2005

(54) METHOD OF PRINTING, ACTIVATING AND ISSUING AN ACTIVATED TIME DEPENDENT LABEL

(75) Inventors: Robert J. Holt, Cornwall-On-Hudson, NY (US); David J. Haas, Suffern, NY (US); Brenda J. Anderson, Anoka, MN (US); Michael J. Schmit, Eden Prairie, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 10/702,213

(22) Filed: Nov. 5, 2003

Related U.S. Application Data

(60) Provisional application No. 60/423,803, filed on Nov. 6, 2002.

(51) Int. Cl.[7] ..... B41J 3/215

(52) U.S. Cl. ..... 400/120.01; 400/120.02; 347/171; 347/176; 347/172; 368/327; 368/114; 116/206

(58) Field of Search ..... 368/327, 114; 347/176, 171, 172; 422/55; 116/206; 400/120.01, 120.02

(56) References Cited

U.S. PATENT DOCUMENTS 4,903,254 A 2/1990 Haas
4,916,112 A 4/1990 Henzel (Continued)

FOREIGN PATENT DOCUMENTS

WO PCT WO 03/077227 A2 9/2003

*Primary Examiner*—Andrew H. Hirshfeld
*Assistant Examiner*—Andrea H. Evans

(74) *Attorney, Agent, or Firm*—Quarles & Brady LLP

(57) ABSTRACT

A method for continuously producing a plurality of printed and activated time dependent labels. In one embodiment, the method comprises providing a web having a plurality of inked substrates thereon. Each substrate has a migrating ink pattern printed on a surface of the substrate. A transfer printer is provided that has a first ribbon means for applying a timing layer through which the migrating ink bleeds after a predetermined period of time. A second ribbon means is provided for printing variable data. The web of inked substrates is continuously fed through the printer, each inked substrate passing sequentially under the first ribbon means and then the second ribbon means. The first ribbon means is activated to apply the timing layer to a portion of the printed surface of each inked substrate thereunder to produce a coated substrate. The second ribbon means is activated to print the variable data information on each coated substrate thereunder, thus continuously producing a plurality of activated time dependent labels having variable data information printed thereon.

In another embodiment for producing a plurality of printed and activated time dependent labels, the web having the plurality of inked substrates thereon is continuously fed through a transfer printer having a single ribbon means. The single ribbon means includes a first ribbon portion for applying a timing layer through which the migrating ink bleeds after a predetermined period of time, and a second ribbon portion for printing variable data. The web is continuously fed through the printer, wherein the first and second ribbon portions pass sequentially over each inked substrate. The first ribbon portion is activated to apply the timing layer to a portion of the printed surface of the inked substrate thereunder, to produce a coated substrate, and then the second ribbon portion is activated to print the coated substrate with the variable data information, thus continuously producing a plurality of activated time dependent labels having variable data information printed thereon.

23 Claims, 5 Drawing Sheets

U.S. PATENT DOCUMENTS 5,364,132 A 11/1994 Haas
5,446,705 A 8/1995 Haas
5,602,804 A 2/1997 Haas
5,633,836 A 5/1997 Langer
5,699,326 A 12/1997 Haas
5,715,215 A 2/1998 Haas
5,719,828 A 2/1998 Haas
5,785,354 A 7/1998 Haas
5,822,280 A 10/1998 Haas
5,873,606 A 2/1999 Haas
5,930,206 A 7/1999 Haas
5,956,067 A * 9/1999 Isono et al. ..... 347/176
5,957,458 A 9/1999 Haas
6,295,252 B1 9/2001 Holt
6,384,854 B1 5/2002 Ibs
6,433,807 B1 8/2002 Francis
6,452,873 B1 9/2002 Holt
6,493,015 B2 * 12/2002 Bhatt et al. ..... 347/171
6,517,239 B1 2/2003 Roth
6,524,000 B1 2/2003 Roth
6,663,945 B2 * 12/2003 Miyano ..... 428/195.1
6,752,430 B2 * 6/2004 Holt et al. ..... 283/72
2002/0105183 A1 8/2002 Holt
2002/0191066 A1 12/2002 Bouchard

* cited by examiner

FIG. 5A
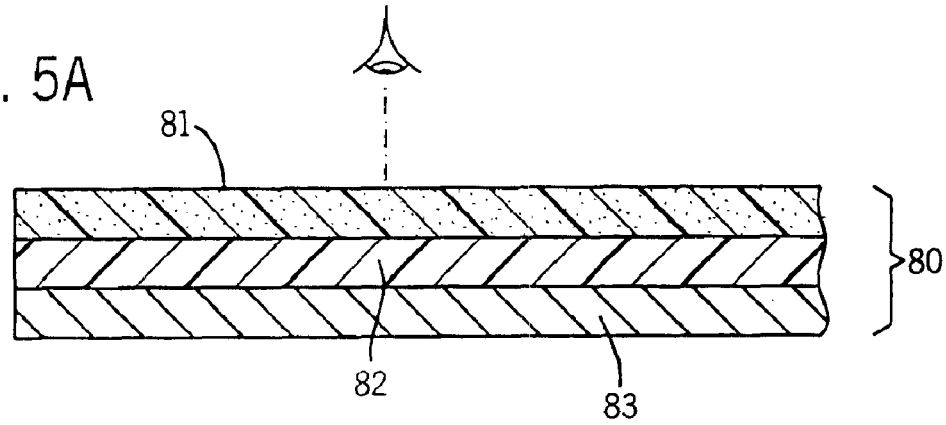
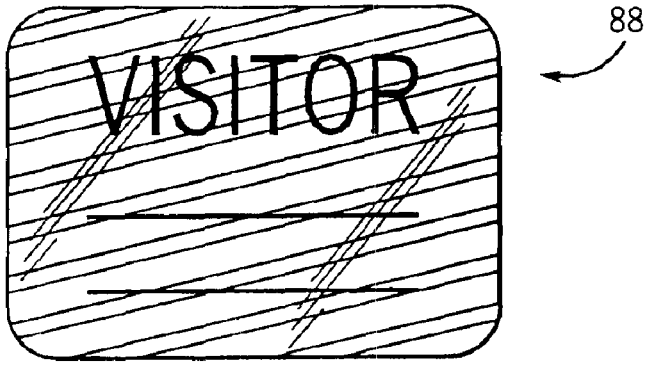
FIG. 5B
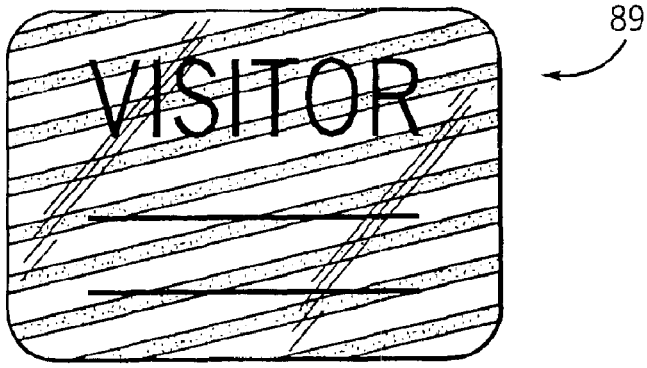
FIG. 5C

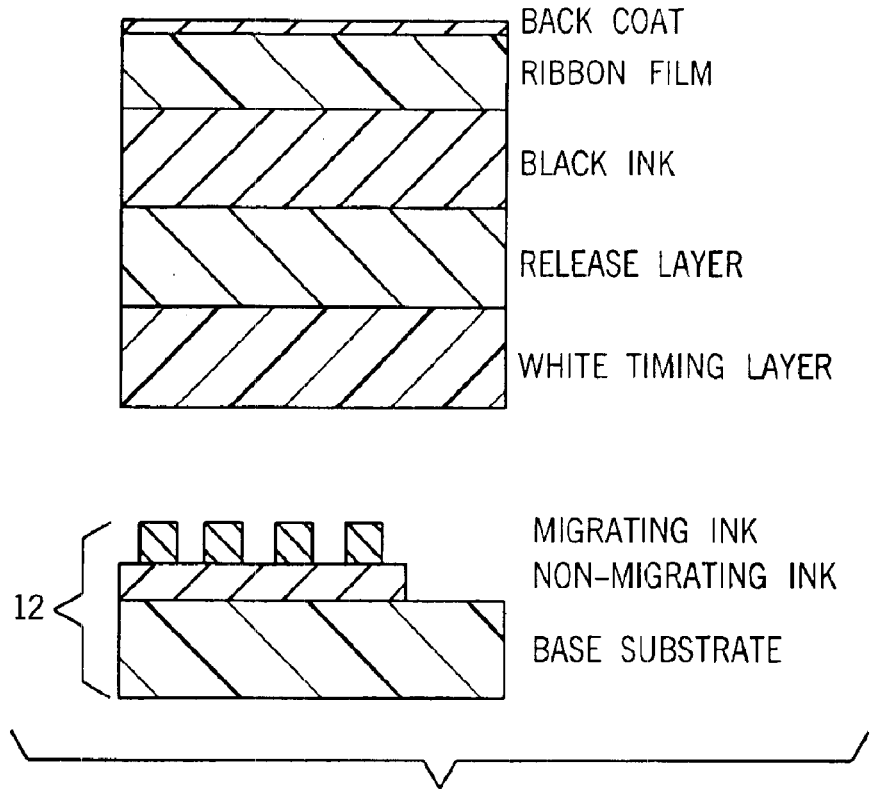
FIG. 8
FIG. 9
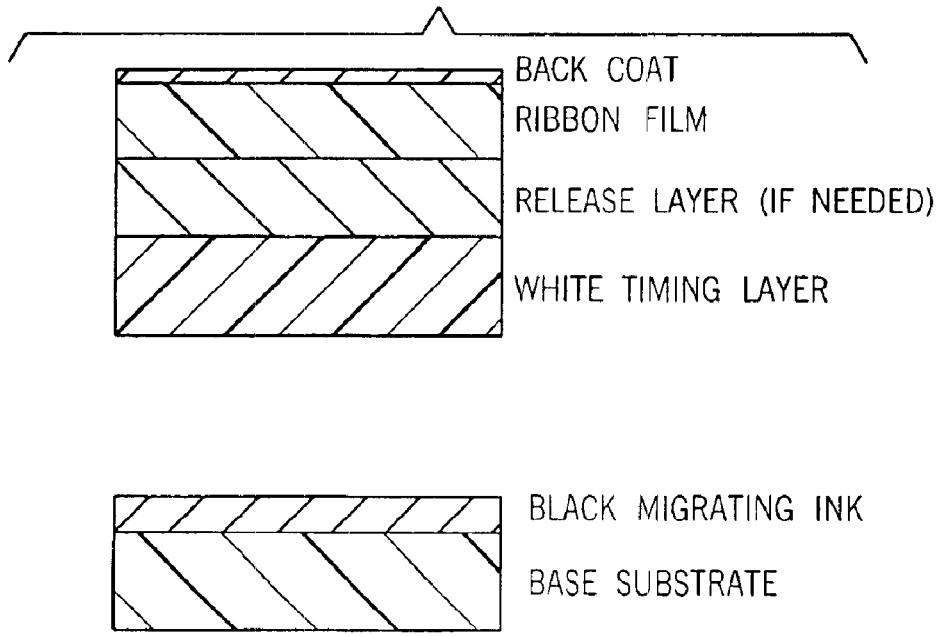

METHOD OF PRINTING, ACTIVATING AND ISSUING AN ACTIVATED TIME DEPENDENT LABEL

RELATED APPLICATIONS

This application claims the priority of Provisional Patent Application Ser. No. 60/423,803, filed Nov. 6, 2002, the entire disclosure of which is incorporated herein by reference.

FIELD OF THE INVENTION

This invention is directed to a method for continuously printing, activating and issuing an activated time dependent label or badge.

BACKGROUND

Time dependent self-expiring visitor labels and badges are well known and presently manufactured and sold by TEMTEC Division of Brady Worldwide, Inc., see for example U.S. Pat. No. 4,903,254. Generally, these labels comprise two parts: a) a front part wherein the rear surface is coated with a pressure sensitive adhesive and the front surface is white, and b) a back part having migrating ink printed on one surface thereof. Printed on the white front face of the front part are the security design and other data, such as the visitor's name, date, time of entry, etc. When the pressure sensitive adhesive on the front part is contacted with the migrating ink printed on the back, the label or badge is activated. After a predetermined period of time the dye bleeds through to the white front part.

This VCP (visually changing paper) technology produces images and colors that appear after a predetermined period of time after activation. The process is primarily physical and chemical in nature and does not employ reactive chemistry, although it may. In known methods and devices, in order to initiate the timing function, a physical assembly must take place that puts the migrating dye materials (on the Back Part) in contact with an active dye absorber layer (the Front Part). Typically this is accomplished with a pressure sensitive adhesive Front Part label applied to the Back Part that is printed with migrating ink The adhesive of the Front Part label contacts the migrating ink dye and initiates the dye diffusion process.

The variable data, e.g., name of the visitor or attendee is usually added to the front part prior to or after activation. When the variable data is written by hand with a pen or marker, it can be done prior to or after activation. However, when a printer is used to add the variable data it is generally always performed before the label is activated because after activation the label is too thick and/or has misaligned substrates making the label difficult or impossible to pass through a printer.

Typically the printer used for applying the variable information to the front part of the label is a dot matrix printer, direct thermal printer, or thermal transfer printer. Once the front part of the label has been printed with the variable data it is removed from the printer and adhesively attached to the surface of the back part that has the migrating ink printed thereon. This activates the self-expiration process of the time dependent label. Typically within a day, the white surface or a portion of the white surface on the front of the label turns red to show its expiration.

There are numerous patents issued that cover the aforedescribed type self-expiring badges, labels and passes. Examples of these products and the technology used by these products are described in the following Haas patents and application, e.g., U.S. Pat. Nos. 5,364,132; 5,446,705; 5,602,804; 5,699,326; 5,715,215; 5,719,828; 5,785,354; 5,822,280; 5,873,606; 5,930,206; 5,957,458; 6,295,252; 6,452,873; and 2002/0105183. The entire disclosures of all of these patents and application are incorporated herein by reference. The products described in these patents have become widely accepted as a means for controlling and improving visitor security and as temporary badges. However, all of these products contemplate the use of a printer prior to activation followed by manual activation, i.e., the front part is manually placed on the back part to activate the time process.

This manual assembly and activation after the printing process in order to issue the self-expiring badges or labels creates certain difficulties. Some of these difficulties are: misalignment of the front part when it is attached to the back part, the length of time required to peel the release liner from the front part and attaching the front part to the back part, the litter caused by the release liners, and the most serious problem, the issuer of the badge failing, by accident or intent, to assemble the two parts. Without proper assembly, the visitor receives a badge with a front part that is continuously valid because it has not been activated to expire.

Other U.S. Patents of interest or relevance are the following:

U.S. Pat. No. 6,524,000 to Roth describes time-temperature indicators activated with direct thermal printing.

U.S. Pat. No. 6,384,854 to lbs et al. discloses a printer controller, e.g., a microprocessor, which is used to control the printing process. Substrates can comprise an identification card blank for receiving thermal printing. The ribbon can comprise a thermal resin.

U.S. Pat. No. 2002/0191066 to Bouchard et al.

U.S. Pat. No. 6,433,807 to Francis et al.

U.S. Pat. No. 5,956,067 to Isono et al.

U.S. Pat. No. 5,633,836 to Langer et al.

U.S. Pat. No. 4,916,112 to Henzel et al.

OBJECTS AND SUMMARY OF THE INVENTION

It is an object of this invention to provide a method for using a computer and thermal transfer printer for printing, activating and issuing an activated time dependent label or badge without manual activation.

It is another object of this invention to provide a method of issuing a fully assembled, activated self-expiring label that is fully printed on the face of the front part, eliminates most, if not all of the problems described above.

It is a further object of this invention to provide a method of issuing a fully assembled, activated self-expiring label that is fully printed on the face of the front part and wherein there is no misalignment of a front and a back part, and can be rapidly assembled, eliminating the time required to peel the front part from its release liner and attaching it to the back part, and avoids litter and prevents the issuance of labels or badges that are not activated.

It is yet another object of this invention to provide a method and apparatus for producing an issued and activated time dependent label or badge that is produced completely within a thermal transfer printer and is a computer controlled process.

The aforedescribed objects of this invention are accomplished by the method of this invention for continuously producing a plurality of printed and activated time dependent labels or badges. In one embodiment, the method comprises. providing a web having a plurality of inked substrates thereon. Each substrate has a migrating ink pattern printed on a surface of the substrate. A transfer printer is provided that has a first ribbon means for applying a timing layer through which the migrating ink bleeds after a predetermined period of time. A second ribbon means is provided for printing variable data. The web of inked substrates is continuously fed through the printer, each inked substrate passing sequentially under the first ribbon means and then the second ribbon means. The first ribbon means is activated to apply the timing layer to a portion of the printed surface of each inked substrate thereunder to produce a coated substrate. The second ribbon means is activated to print the variable data information on each coated substrate thereunder, thus continuously producing a plurality of activated time dependent labels having variable data information printed thereon.

In another embodiment for producing a plurality of printed and activated time dependent labels, the web having the plurality of inked substrates thereon is continuously fed through a transfer printer having a single ribbon means. The single ribbon means includes a first ribbon portion for applying a timing layer through which the migrating ink bleeds after a predetermined period of time, and a second ribbon portion for printing variable data. The web is continuously fed through the printer, wherein the first and second ribbon portions pass sequentially over each inked substrate. The first ribbon portion is activated to apply the timing layer to a portion of the printed surface of the inked substrate thereunder, to produce a coated substrate, and then the second ribbon portion is activated to print the coated substrate with the variable data information, thus continuously producing a plurality of activated time dependent labels having variable data information printed thereon.

In another embodiment of this invention, a web is provided that has a plurality of inked substrates having a migrating ink pattern printed on a surface of the substrate. A transfer printer is provided having a ribbon means for applying a timing layer through which the migrating ink bleeds after a predetermined period of time, and for printing variable data. The web of inked substrates is continuously fed through the printer, wherein the ribbon passes over each inked substrate. The ribbon is activated to simultaneously apply the timing layer to a portion of the printed surface of the inked substrate thereunder to produce a coated substrate and to print the coated substrate with the variable data information. Thus, a plurality of activated time dependent labels having variable data information printed thereon is continuously produced. Optionally, the coated substrate is reverse printed with variable data.

BRIEF DESCRIPTION OF THE DRAWINGS

Other important objects and features of the invention will be apparent from the following Detailed Description of the Invention taken in connection with the accompanying drawings in which:

FIG. 5A is a cross-section of an issued time dependent label or badge produced by the method of this invention.

FIG. 5B is a front view of an issued time dependent label or badge produced by the method of this invention just after activation.

FIG. 5C is a front view of an issued time dependent label or badge produced by the method of this invention just after expiration.

FIG. 8 is a cross section of a third embodiment of a ribbon used in the transfer printer to apply the timing layer to the inked substrate and the preprinted substrate used in the method of this invention.

FIG. 9 is a cross section of another embodiment of a ribbon used in the transfer printer to apply the timing layer to the inked substrate and the preprinted substrate used in the method of this invention.

DETAILED DESCRIPTION OF THE INVENTION

Figure 1:
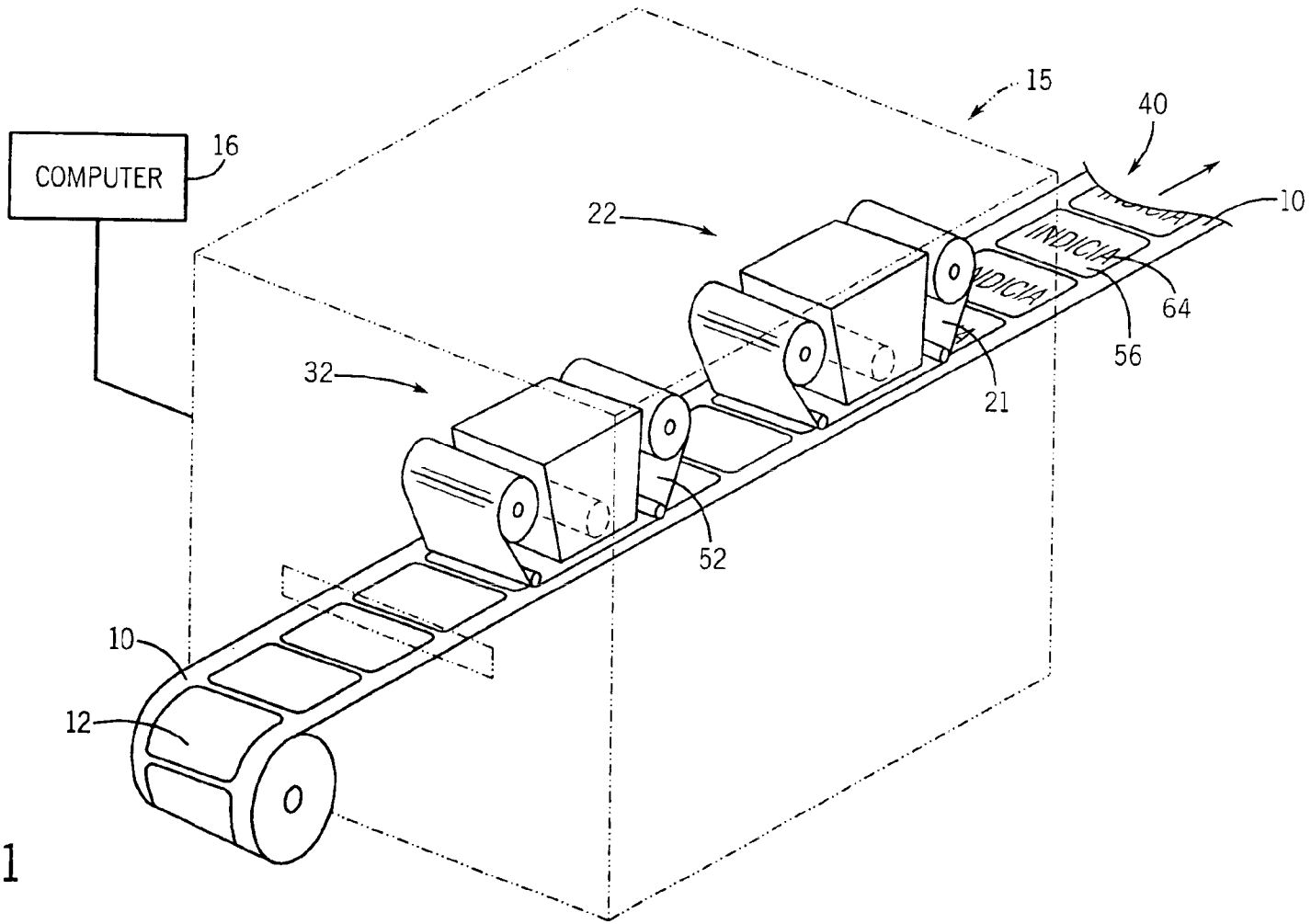
FIG. 1 is a schematic of the apparatus used in this invention comprising a computer and thermal transfer printer for continuously printing, activating and issuing an activated time dependent label or badge.

The color changing time processes and chemistry used to produce the labels and badges herein are substantially similar to that described in the Haas patents and application previously mentioned, i.e., U.S. Pat. Nos. 5,364,132; 5,446,705; 5,602,804; 5,699,326; 5,715,215; 5,719,828; 5,785,354; 5,822,280; 5,873,606; 5,930,206; 5,957,458; 6,295,252; 6,452,873; and 2002/0105183. The entire disclosures of all of these patents and application are incorporated herein by reference. Generally, the migrating ink dye printed on the label slowly bleeds into the white coating on the label and after a predetermined period of time, e.g., one day, the white front of the label turns red, showing expiration.

A primary feature of this invention is to provide a method for continuously producing a plurality of activated and printed (issued) time dependent labels or badges with a computer controlled thermal transfer printer. For the sake of brevity herein, such labels or badges will be referred to herein as "labels." Broadly, the assembly comprises transferring the various coatings in the VCP construction from different ribbons, from sequential panels or portions within one ribbon, or from one ribbon onto a substrate. By the use of the term "substrate" it is meant, for example, a paper label, or badge. The substrate is printed, coated or overlaid with a migrating ink pattern which is subsequently coated with a white timing layer through which the migrating ink bleeds followed by printing the variable data information thereon. Optionally a clear enhancement layer overlays the timing layer.

The apparatus and method of this invention can produce a time dependent label (VCP product) from a plurality of thermal ribbon coatings in one pass through a printer controlled by a computer.

The printer may be a conventional thermal transfer printer with one or more print heads. Such printers, card printers, processors and systems are well known in the art and sold by numerous companies, e.g., Tharo Systems, Inc., Zebra Technologies International, LLC (Eltron) and Fargo Electronics, Inc. (Fargo).

Referring to FIGS. 1–4, a web 10 having a plurality of inked substrates thereon, i.e., die cut labels 12 which have been p reprinted or coated with migrating ink 54, is fed into a transfer printer 15, preferably a thermal transfer printer, which is controlled by computer 16. The first print head 32 has a ribbon 52 which carries and is used to apply a white timing layer or coating 56 over each of the labels 12 on the web 10 covering the migrating ink 54 printed thereon. The second print head 22 is a thermal transfer printing device with a dark thermal transfer ribbon 21 for printing variable data 64 onto the white timing layer 56 attached to the label 12, such as the visitors name and other relevant information. The system produces a web of printed and activated time dependent labels 40 (typically white) suitable for distributing to the user of the label that will expire in a predetermined period of time, e.g., one day. The computer 16 provides the operating sequence for the printer as well as providing the variable data to be printed onto the label.

Figure 3:
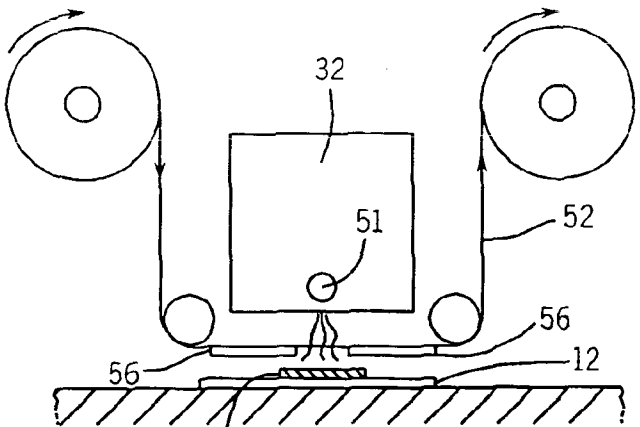
FIG. 3 is a schematic of a print head used in this invention used to activate the time dependent label or badge.

Optionally, although not shown in the Figures, a single thermal transfer print head similar to that depicted in FIG. 3, may be used with a single ribbon to produce the activated and printed time dependent labels. In particular, the inked substrate is fed through the printer wherein the inked substrate passes sequentially under a first coating ribbon portion and a print ribbon portion. This is accomplished by providing a ribbon with sequential panels, i.e., a coating panel followed by a print panel. More particularly, the web 10 having the plurality of inked substrates 12 thereon is continuously fed through a transfer printer having a single ribbon means. The single ribbon means includes a first ribbon portion for applying a timing layer 56 through which the migrating ink bleeds after a predetermined period of time, and a second ribbon portion for printing variable data 64. The web is continuously fed through the printer, wherein the first and second ribbon portions pass sequentially over each inked substrate. The first ribbon portion is activated to apply the timing layer to a portion of the printed surface of the inked substrate thereunder, to produce a coated substrate, and then the second ribbon portion is activated to print the coated substrate with the variable data information, thus continuously producing a plurality of activated time dependent labels having variable data information printed thereon.

The chemical composition of the white timing layer 56 that is applied to the printed label 12 is highly dependent on the particular dyes used in the migrating ink that is printed or coated on the substrate. For example, employing hydrophobic dyes for printing will require a white timing layer 56 to be made of hydrophobic like materials such as urethane or polyolefin. Employing hydrophilic dyes for printing will require that the white timing layer 56 be ionic in nature such as vinyl or polyester. Thus, the timing for the dye migration will be a function of the particular timing layer materials, its thickness, the type and amount of other additives such as whiting agent (example: $TiO_2$), plasticizers and fillers added.

Additionally, it is possible to add low molecular weight organics to the substrate or inks that are printed thereon that diffuse into the timing layer and alter the timing characteristics of the dye migrating through the timing layer. The timing characteristics for these time dependent labels must all be formulated for the specific temperatures and conditions of use.

A property of thin printed layers or coatings like the timing layer 56 herein is their inability to hide non-uniform backgrounds. For example, black and white printing on a white substrate produces sharp contrast differences. Thin white coatings as the timing layer do not always have the ability to hide these contrasts and the images printed in migrating ink show through the white timing layer to coating. Thus, the white timing layer is not opaque, but is translucent.

The inventors have solved this problem by printing the migrating ink onto a substrate which is not white, but dark in color so that the contrast between the migrating ink and background is low.

When the white timing layer is placed over this low contrast background, the image printed in migrating ink does not show through the timing layer. This technique permits the use of a very thin translucent timing layer that can provide after the predetermined period of time has expired, a relatively sudden color change from solid white to red.

Another advantage of having a dark or black substrate is that the variable data can be printed on the white timing layer by reverse printing. Reverse printing yields a white background with the black background showing the data. This eliminates the need for a second ribbon to print the variable data.

Figure 2:
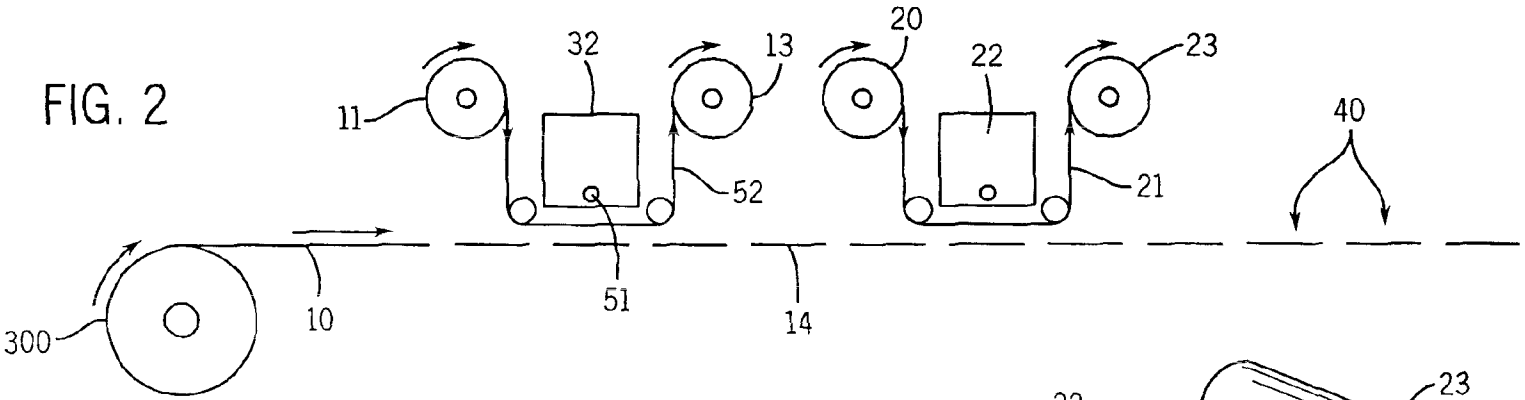
FIG. 2 is a schematic of the thermal transfer printer used in this invention for printing, activating and issuing an activated time dependent label or badge.

Referring to the printer 15 in more detail and to FIG. 2 and 3, which is a schematic of the thermal transfer printer used in this invention, a web 10 of labels 12 with migrating ink printed or coated thereon is continuously fed into the printer 15 from large feed rolls 300. These labels exit the printer 15 as a web of fully printed and activated labels 40. No cutting or folding of the label or its liner is required. The label enters the first print station or print head 32 where it is placed in intimate contact with coating ribbon 52. The ribbon 52 is fed into the first print station 32 from feed roller 11 and the waste ribbon 52 is wound up on take-up roller 13. The white timing layer 56 is transferred from the ribbon 52 to the label substrate 12 by means of heat, which is produced by the print head 32 heating element or array of elements 51. The timing layer 56 can be designed to stick to almost any kind of substrate label 12, whether the substrate is paper, plastic or cloth material or combinations thereof. Depending on the nature and thickness of the timing layer 56, the heating element(s) 51 may be substantially hotter and more robust than conventional thermal transfer printing elements. Because of the pressure and heat being applied to the timing layer 56 obtained from ribbon 52 while the layer 56 is in intimate contact with the label 12, the coating melts, transfers to the preprinted label 12, 54 and then cools on the label where it becomes substantially attached to the paper fibers or plastic film.

Referring to FIG. 3, the thermal transfer printing ribbon 52 is a standard product widely manufactured throughout the world. However, what is unique is that the timing layer 56 that is placed on the preprinted label 12 is mounted to the ribbon 52 and when heated by element(s) 51 is transferred as a uniform layer to the preprinted label substrate 12, 54. In general, the heating element(s) 51 will have all of its elements across the width of the label 12 on or off at the same time in order to transfer a wide, uniform timing layer 56 across this width portion of the label 12.

This process produces an activated label 14 which has an opaque white face and appears similar, if not identical, to a white paper label. This provides a white substrate media for printing the variable data 64 such as the persons name, etc.

Figure 6:
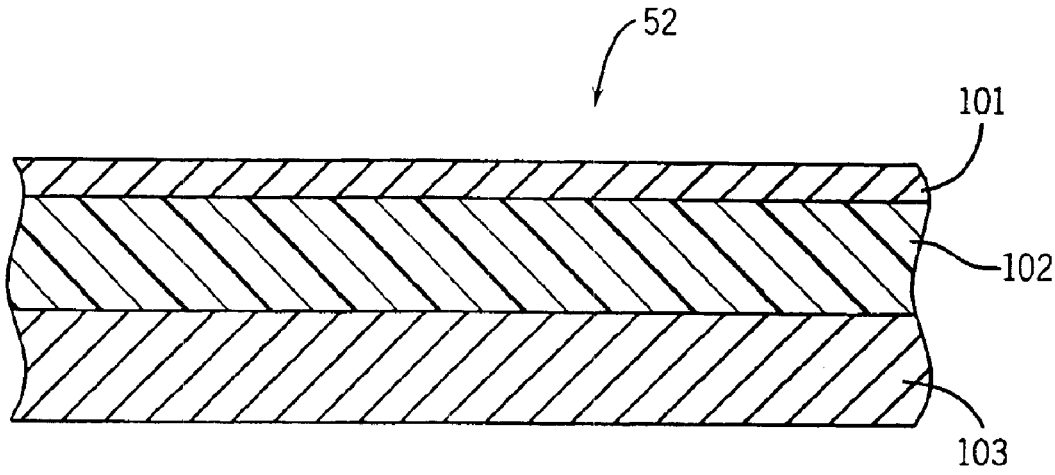
FIG. 6 is a cross section of one embodiment of a ribbon used in the transfer printer to apply the timing layer to the inked substrate in the method of this invention.

FIG. 6 depicts a cross section of one embodiment of a first coating ribbon 52 used at the first print head 32 of the heat transfer printer 15 to coat a preprinted label with a timing layer. The ribbon 52 comprises three layers: a slip layer 101 that contacts the print head (32 in FIG. 3), and a film carrier material 102 and a timing layer 103 that is transferred to the preprinted label substrate.

Preferably the ribbon 52 comprises a film carrier material 102 which is a polyester film of about 0.25 to 0.5 mil thickness. On top of this film carrier material 102 is a low friction slip layer 101, which permits the ribbon 52 to easily slide over the print head. The timing layer 103 on the lower side of the ribbon 52 is pressed in intimate contact with the preprinted substrate. As the ribbon 52 is pressed onto the substrate, the timing layer 103 adheres by any of several means to the substrate and is stripped from the film carrier material 102 as both the ribbon 52 (now 101 and 102) is transported through the printer.

Figure 4:
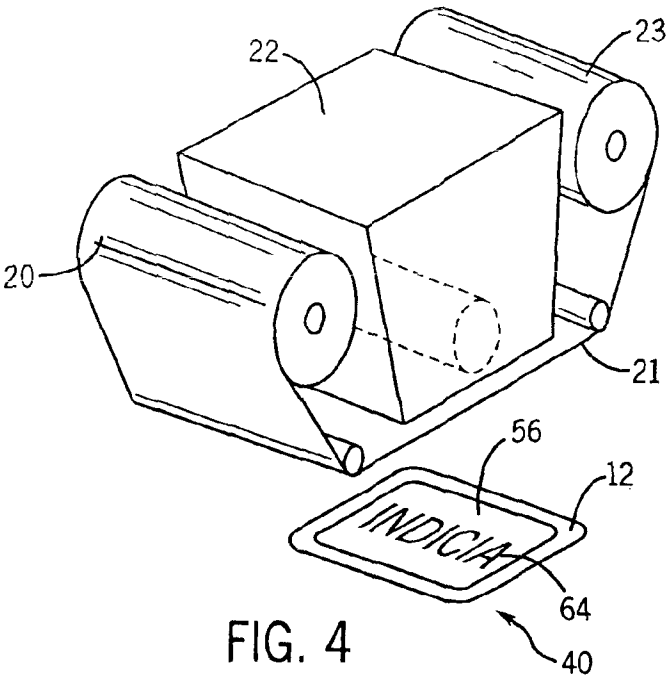
FIG. 4 is a schematic of a print head used in this invention used to print and issue the time dependent label or badge.

Again referring to FIG. 2 as well as FIG. 4, the white activated label 14 is transported from the first print station 32 to the second print station 22. Here the activated label 14 is placed in intimate contact with the thermal transfer ribbon 21 that is fed to the print station by feed-roller 20 and take-up roller 23. As the thermal transfer ribbon 21 and label 14 are contacted with each other they pass under the printing (heating) element(s) of station 22, wherein portions of the ink coating on the thermal transfer ribbon melts and sticks to the white timing layer on the label. This ink pattern produces the variable printed data 64 that completes the time dependent label. After completing the data printing process, the label 40 is ejected from the printer so that the operator can issue the label to the visitor.

Typically when the substrate label is printed with the migrating ink prior to entering the first printing station 12 (FIG. 2), the printed pattern will not be solid or continuous, but the pattern will be dots with portions of the natural substrate exposed between the dots. This is important in order to assure a strong bond between the timing layer 56 and the substrate material 12. Since the migrating dye 54 is typically printed onto the label substrate 12 by means of a printing press, the print could interfere with the bonding of between the timing layer 56 and the substrate.

In the preferred embodiments of this invention, it is desirable to produce a time dependent label 40 having a multiple layer construction. In particular it is preferred that the face of the white timing layer 103 be overlaid with a clear enhancement layer to permit the migrating dye to concentrate in front of the white timing layer. Without this clear enhancement layer, the dye remains intermixed with the whitening agent such as titanium dioxide and therefore, does not become a dark color, like dark red. By concentrating the colored dye in a clear media one obtains a dark, intense color to clearly show that the ID label has expired.

Figure 7:
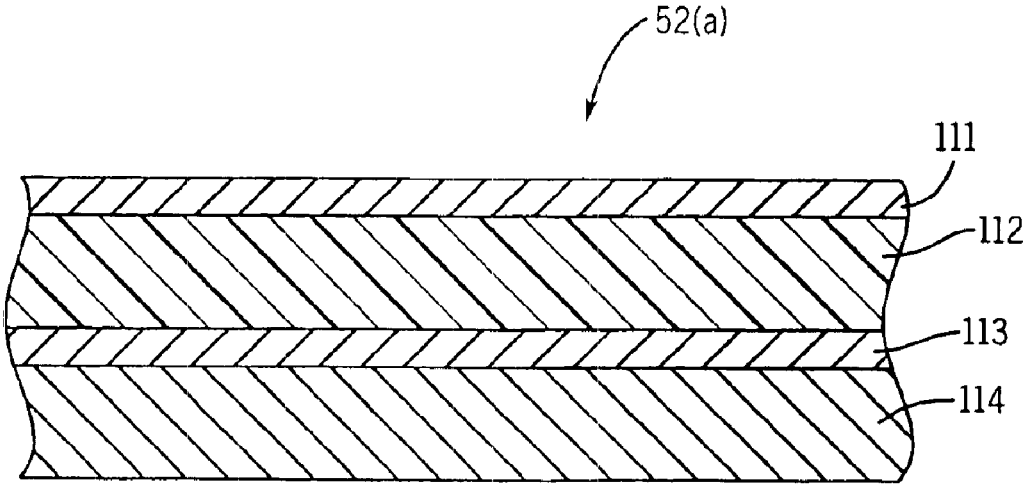
FIG. 7 is a cross section of a second embodiment of a ribbon used in the transfer printer to apply the timing layer to the inked substrate in the method of this invention.

FIG. 7 depicts a cross section of another embodiment of a first coating ribbon 52a used at the first print head 32 of the heat transfer printer 15 to coat a preprinted label with a timing layer. The timing coating ribbon 52*a* comprises a slip layer 111 that contacts the print head (32 in FIG. 3), a carrier ribbon 112 and the clear enhancement layer 113 adhered to the white timing layer 114. As the ribbon 52*a* is pressed onto the substrate, usually with heat, the transfer coating 114 adheres by any of several means to the preprinted substrate having attached thereto the clear enhancement layer 113, and is stripped from the film carrier material 112 as both the ribbon 52a (now 111 and 112) is transported through the printer. This composite construction is an alternative to making two separate ribbons or ribbon portions that are transferred sequentially.

It is also possible to have multiple print heads for applying different timing layers. For example, if we have two print heads, there can be one for producing a one-day expiration portion for a label and another for producing a one-week expiration portion for such label. Thus, the time dependent label may show authenticity and expiration by having the one-day portion turn red to show it was issued a day ago, yet still remain valid for the remainder of the week, with the second one week timing portion expiring thereafter.

FIG. 4 shows a schematic of the second print head 22 used in this invention to print the variable information 64 to issue the time dependent label. The activated substrate label 14 lays flat with the timing layer 56 covering all or a portion of the substrate label 12. The variable data 64 is printed onto the timing layer 56 by means of the print head 22.

In the type of thermal transfer printer that may be used in this invention, it is common to have more than one color print head so that the operator can print pictures and graphics onto the labels. Thus, whereas print head 22 is shown as a single unit, print head 22 could be replaced by a plurality of print heads to enable the printing of multi-color graphics and images. These are all printed on the white timing layer 56 in order to make a more secure and aesthetically pleasing label.

Optionally, it is possible to produce an authenticity device, such as a gold hologram, foil printed on the substrate as a graphic image or simply a metallic design, either being printed on top of a short term timing material, which produces a unique color to appear throughout the metallic design. This authenticity device is designed so that it could only be produced with this type of a printer construction.

Other additional benefits of the method of this invention can be the employment of a segmented heated print head wherein only portions of the preprinted substrate are coated and not the entire substrate. For example, the printing device may be used for printing different size labels, such 2"×3" or 3"×3" and only a portion of the larger label is coated, leaving the uncoated portion visible. Likewise, an operator could also print only an isolated area, such as a 1"×1" square on a label in order to reduce the label cost.

FIG. 5A is a cross section of the issued and activated time dependent label produced by this invention. The observer views the issued label 80 from the front. Referring to FIG. 5B, the label 88 appears white and the variable data is legible showing that it is a valid security label. Initially the white timing layer 81 is uniform in appearance and the observer cannot see the colored migrating ink 82 as coated underneath. The label 80 is constructed on the substrate 83 that may or may not have adhesive attached to the rear thereof. Referring to FIG. 5C, after the designated time, the red dye from the migrating ink layer 82 passes through the white timing layer 81 turning the label red 89, changing the label from valid to void (expired).

The materials used in the ribbons are known in the art. The materials commonly used are polymers, waxes, additives, tackifiers, fillers and pigment. Other layers could be incorporated into the ribbon such as release layers that allow easy release of the other layers in the ribbon. There can be a release layer between the enhancement layer and the ribbon. The release layer could be composed of low melting point polymers, waxes, silicone based resins, Teflon type materials, etc. that are well known in the art.

In one embodiment of this invention, the label substrate has a pressure sensitive adhesive which contains a migrating dye on its outside or top surface. The timing layer from the ribbon can be applied to the preprinted substrate by mere pressure of the first print head (no heat). The label substrate would be self-wound so that the adhesive is exposed as soon as it comes off the feed roll. The primary benefit of a pressure sensitive adhesive attachment is that no heat is applied to any of the elements.

In another embodiment, the timing layer employs a co-adhesive coating that reacts with a co-adhesive coating on the preprinted substrate to cause them to adhere to each other. In this case, neither co-adhesive has tack so that it does not have to be protected from contact with other objects by a release liner. Simply pressing the two co-adhesives coatings together will cause them to form a firm adhesion bond. This assembly also eliminates the need for heat to attach the timing layer to the preprinted substrate.

In yet another embodiment, the timing layer is coated onto the preprinted substrate by employing a heat transfer method which either employs a heat activated adhesive or actually causes the timing layer to melt and coat the substrate so that in the heated, liquid state, it flows onto the substrate coats and bonds thereto. The heat activated coating also offers the ability to control the portion of the preprinted label that is covered by the timing layer. For example, if only half the heating elements are activated, then the coating will only be half as wide as a full coating. This offers the benefit of being able to "spot apply" the timing layer coating onto the preprinted substrate.

A preferred embodiment of a three layer thermal transfer ribbon is similar to that depicted in FIG. 8. In this embodiment, the ribbon comprises a 0.25 mil polyester film (Toray Plastics America, Inc.; Toray Industries, Inc.) Ribbon Film that contains a slip layer Back Coat on one side. On the opposite of the Ribbon Film is a coated (2 lbs/ream) black thermal ink layer, Black Ink, followed by a Release Layer (0.1 lbs/ream), and the third layer is a White Timing Layer (5 lbs/ream). The White Timing Layer transfers to the printed substrate 12 by pressure from the print head and is released from the film after the head lifts. The black thermal layer, Black Ink and the Release Layer are released from the Ribbon Film by heat from the print head. An additional layer (not shown) may be used between the Black Ink layer and the Ribbon Film. Such release layers are well known in the art.

The following is a description of the preferred elements of this preferred ribbon:

| Layer | % by weight | Component Name |
|---|---|---|
| Black Ink | 5 | Daran SL143 (PVDC $T_g$ = 15 C.) |
| | 38 | Vycar 352 (vinyl emulsion, $T_g$ = 62 C.) |
| | 6 | Hycar 1561 (acrylonitrile, $T_g$ = −19 C.) |
| | 25 | Tint Ayd NV7345 (black pigment dispersion) |
| | 26 | Vycar 151 (vinyl emulsion $T_g$ = 85 C.) |
| Release Layer | 95 | Teflon PTFE-35 |
| | 5 | Vancryl (acrylic Emulsion $T_g$ = 5 C.) |
| White Timing Layer | 60 | Tint Ayd NV7003 $TiO_2$ dispersion |
| | 30 | Hycar 26288 (acrylic emulsion $T_g$ = 25) |
| | 10 | Water |

Vycar and Hycar are trademarks of Noveon Inc.
Daran is a trademark of W. R. Grace and Co.
Tint Ayd is a trademark of Elementis Specialties, Inc.
Teflon is a trademark of E.I. du pont de Nemours and Company
Vancryl is a trademark of Air Products and Chemicals, Inc.

Still referring to FIG. 8, the preprinted substrate 12 used with this ribbon can be any standard receiving media that is used in the art. Such a substrate has printed on the surface Migrating Ink using common migrating dyes found in the art. The Migrating Ink can be printed using different patterns, words, logo or insignias. The surface of the Base Substrate upon which the Migrating Ink is carried may also have thereon Non-Migrating Ink patterns and a coating of a co-adhesive (for use with the co-adhesive on the timing layer), adhesive (for adhering to the timing layer) or resin layer to which the timing layer is adhered by heat or adhesive. In the above example, the preferred preprinted substrate is a pressure sensitive adhesive, which contains 5–20% by weight of a migrating dye such as C.I. Disperse Red 60, 0.5–1.0 mil thick.

The purpose of the black/dark migrating and non-migrating ink is two fold. One is to provide the dark contrast of the reverse printed timing layer in order for the variable data to be seen as normal print. The other purpose is that the ink also serves as a pressure sensitive adhesive containing the migrating component(s). The function of the pressure sensitive adhesive is that the white timing layer adheres to the inked substrate and transfers or separates from the ribbon after the print head. This substrate is provided in roll form and wound upon itself. The backside of the substrate may have coated on it a release coating containing such polymers as polysiloxane, commonly used in liner paper or other release materials. After the substrate is unwound in the printer, the adhesive must not permanently stick to any surface, treated rollers would be needed in the printer. This inked substrate material is similar in a way to linerless label media used in thermal transfer printers whereas the backside of the substrate has pressure sensitive adhesive exposed and is self wound. In this case, the adhesive is faced up/out instead of face down/in. The adhesive properties only need to be strong enough to remove the white timing layer from the ribbon. A weak adhesive would be sufficient and remain easy to handle.

In another embodiment, depicted in FIG. 9, a single layer ribbon can be used similar to that depicted in FIG. 6. The Ribbon Film is coated with a White Timing Layer, (5 lbs/ream). The preprinted substrate, Base Substrate, has a printed or coated thereon a black/dark layer or multiple black/dark layers, Black Migrating Ink, with one of the layers in a pattern, logo or words and another of the layers containing the migrating ink/dye. Such a label may be printed after activation using the thermal transfer ribbon in a reverse image. A reverse image or negative image is transferred across the entire label, covering the black color. Areas that do not have the white thermal transfer ink will appear black to the viewer. The black areas will appear to the end user as the printed information on a white background.

The preferred materials used are:

White Timing Layer

| % by weight | |
|---|---|
| 9.5 | Rhoplex B85 (Acrylic Emulsion, $T_g$ = 85 C.) |
| 4.8 | Aroset 3300 (Acrylic PSA) |
| 19.1 | Vycar 352 (vinyl emulsion, $T_g$ = 62 C.) |
| 4.8 | Hycar 1561 (acrylonitrile, $T_g$ = −19 C.) |
| 61.9 | Tint Ayd NV7003 $TiO_2$ dispersion |

Rhoplex is a trademark of Rohm and Haas Company
Aroset is a trademark of Ashland Inc.
Vycar and Hycar are trademarks of Noveon Inc.
Tint Ayd is a trademark of Elementis Specialties, Inc.

Black Migrating Ink on Base Substrate

| % by weight | |
|---|---|
| 78 | NeoRez R9000 (urethane) |
| 2 | Sublaprint Red 7011-M |
| 10.4 | Vycar 352 (vinyl emulsion, $T_g$ = 62 C.) |
| 9.6 | Tint Ayd NV7345 (black pigment dispersion) |

NeoRez is a trademark of NeoResins (a business unit of Avecia Limited)
Sublaprint is a trademark of Keystone Aniline Corporation.
Vycar is a trademark of Noveon Inc.
Tint Ayd is a trademark of Elementis Specialties, Inc.

In another similar embodiment, an additional layer can be added to the previous example. A two layer ribbon can be used. A clear enhancement layer can be used between the white timing layer and the polyester film. The clear layer will transfer with the white timing layer. The function of this layer is to allow the dye to migrate through the white timing layer and concentrate in the clear layer. The result is a more intense final color since the majority of the colorant resides in front of the white pigment. It enhances the final color. The layer also may help or assist in releasing the white layer from the film and act as a release layer.

The preferred materials used are the same as the previous example except it includes the following materials for the clear enhancement layer.

| Clear Enhancement Layer (FIG. 7, 113) | |
|---|---|
| % by weight | |
| 56.6 | Rhoplex B85 (Acrylic Emulsion, $T_g$ = 85 C.) |
| 34 | Aroset 3300 (Acrylic PSA) |
| 9.4 | Hycar 1561 (acrylonitrile, $T_g$ = −19 C.) |

Rhoplex is a trademark of Rohm and Haas Company
Aroset is a trademark of Ashland Inc.
Hycar is trademark of Noveon Inc.

Typical Operation

With two print head printers, there is a first ribbon for applying the timing layer to the preprinted substrate to activate the label and a second ribbon to apply the variable data to the face of the activated label. The preprinted substrate enters the printer from a roll on one side and is ejected from the printer from the other side of the printer. After installing the two ribbons and the roll of preprinted substrate into the printer, the computer is activated to control the feed and print head parameters as well as the variable data to be printed.

The preprinted substrate advances to the first print head, then the timing layer is placed in contact with the preprinted substrate, and the two are driven under the print head simultaneously. This applies the timing layer to the face of the preprinted substrate and initiates or activates the time expiration process. The first print head is lifted so that the timing layer ribbon releases its contact with the substrate. The substrate label with timing layer attached thereto then advances to the second print head where the imaging ribbon is placed into contact with the substrate. As the substrate passes under the print head, the variable data pattern is energized so that the variable data is applied on top of the timing layer. When all the variable data is printed, the second print head lifts off the label substrate. Then the finished label is ejected from the printer and issued to the person(s).

Although this invention contemplates a multiple head printer and a single head printer, a multiple head printer is preferred. For example, the two print head printer described may be more advantageous than a single print head unit, because the web having the labels thereon advances simultaneously through both the first and second print heads and is printed simultaneously by both heads. In a single print head unit, the ribbon for the single print head has two or more panels on it and the web of labels must reverse after each panel is printed and realigned with the print head for applying the next layer (print or timing label) for a second pass under the print head. The reversing and reprinting requires a more complicated drive mechanism as well as more precise sensor marks on the label in order to position it exactly. Further, a two print head printer generally has a greater throughput per unit of time than a single print head printer. Additionally, a multiple panel ribbons cannot employ a mechanism called a "ribbon saver" because each of the two panels must be completely used for printing of a single label. Thus, with ribbon savers on the ribbons of the two head printer, one could extend the use of the ribbon substantiality by printing smaller time spots on each label instead of a full label. With a single head printer, the ribbon will have two panels and the transport mechanism will move the label under the print head with the first panel, timing layer, being transferred onto the substrate. Then the print head is raised to separate the ribbon from the substrate and the substrate label is returned to its beginning position. Then the second printing pass is performed. Thereafter, the label is ejected from the printer with the entire construction of the self-expiring label complete.

The time dependent labels produced by the method of this invention have many advantages when compared to the prior art methods of printing and activating such labels:

Minimizes any misalignment of the parts of the label, i.e., front and back parts.

Eliminates the time required for peeling the front part from its release liner and attaching it to the back part for activation.

Eliminates litter from the release liner pulled from the front part.

The issuer cannot fail to activate the label because the activation is performed inside the thermal transfer printer.

Preprinted security designs can be provided on the Substrate insuring authenticity control.

More rapid issuance of labels.

Computer data can be downloaded in order to print thousands of labels for shipping, security, authorization, admission that are complete and activated to self-expire, providing a time indicator label that is much more versatile than ID labels only.

Lower cost per label.

No activation by user.

No label is issued that is not activated.

Only one label material is required as the primary component of the label.

Time indicators can be applied to product labels such as food. products, pharmaceuticals, etc.

There are many other possible uses for the labels, badges and the like produced by this invention, for example:

Security ID labels, self-expiring parking tags, package and shipping labels, wrist bands, tickets, self-expiring passes for tours, emergency rooms, hospitals, museums, and other locations with open doors or many doors, backstage passes, race track passes, baseball dugout passes which are issued specifically for one-day control in addition to the admission ticket, security labels for screened luggage, purses, bags at airports to show the aircraft control people that the particular items were inspected, unmanned but video controlled entrances for visitors where the self- expiring visitor label issued electronically from a kiosk printer.

While various changes may be made in the detailed construction and processes of this invention, it will be understood that such changes will be within the spirit and scope of the present invention.

Having thus described the invention in detail, it is to be understood that the foregoing description is not intended to limit the spirit and scope thereof. What is desired to be protected by Letters Patent is set forth in the appended claims.

What is claimed is:

1. A method of continuously producing a plurality of printed and activated time dependent labels, comprising:

providing a web having a plurality of inked substrates thereon, each substrate having a migrating ink pattern printed on a surface of the substrate, providing a transfer printer having a first ribbon means for applying a timing layer through which the migrating ink bleeds after a predetermined period of time, and a second ribbon means for printing variable data, continuously feeding the web of inked substrates through the printer, wherein each inked substrate passes sequentially under the first ribbon means and then the second ribbon means, activating the first ribbon means to apply the timing layer to a portion of the printed surface of each inked substrate thereunder to produce a coated substrate, and activating the second ribbon means to print the variable data information on each coated substrate thereunder, whereby a plurality of activated time dependent labels having variable data information printed thereon are continuously produced.

2. A method of continuously producing a plurality of printed and activated time dependent labels, comprising:

providing a web having a plurality of inked substrates thereon, each substrate having a migrating ink pattern printed on a surface of the substrate, providing a transfer printer having a ribbon means that includes a first ribbon portion for applying a timing layer through which the migrating ink bleeds after a predetermined period of time, and a second ribbon portion for printing variable data, continuously feeding the web of inked substrates through the printer, wherein the first and second ribbon portions pass sequentially over each inked substrate, activating the first ribbon portion to apply the timing layer to a portion of the printed surface of the inked substrate thereunder, to produce a coated substrate, and then activating the second ribbon portion to print the coated substrate with the variable data information, whereby a plurality of activated time dependent labels having variable data information printed thereon are continuously produced.

3. The method of claim 1, wherein the printer is a thermal transfer printer.

4. The method of claim 2, wherein the printer is a thermal transfer printer.

5. The method of claim 1, wherein the timing layer further comprises a clear enhancement layer.

6. The method of claim 2, wherein the timing layer further comprises a clear enhancement layer.

7. The method of claim 1, wherein the feeding of the web, activating of the first and second ribbon means and the variable data information are controlled by a computer.

8. The method of claim 2, wherein the feeding of the web, activating of the first and second ribbon portions and the variable data information are controlled by a computer.

9. The method of claim 1, wherein the migrating ink pattern is printed on a dark background on the substrate and the variable data information is reverse printed on the coated substrate.

10. The method of claim 1, wherein the migrating ink pattern is printed on a dark background on the substrate and the variable data information is positive printed on the coated substrate.

11. The method of claim 2, wherein the migrating ink pattern is printed on a dark background on the substrate and the variable data information is reverse printed on the coated substrate.

12. The method of claim 2, wherein the migrating ink pattern is printed on a dark background on the substrate and the variable data information is positive printed on the coated substrate.

13. The method of claim 1, wherein the timing layer is thermoplastic and is applied to the substrate by heating the layer and contacting the layer with the substrate to thermoplastically adhere the layer to the substrate.

14. The method of claim 2, wherein the timing layer is thermoplastic and is applied to the substrate by heating the layer and contacting the layer with the substrate to thermoplastically adhere the layer to the substrate.

15. The method of claim 1, wherein the timing layer has a pressure sensitive adhesive thereon and is applied to the substrate by contacting the layer with the substrate to adhere the layer to the substrate.

16. The method of claim 2, wherein the timing layer has a pressure sensitive adhesive thereon and is applied to the substrate by contacting the layer with the substrate to adhere the layer to the substrate.

17. The method of claim 1, wherein the timing layer has a first co-adhesive thereon and the substrate has a second co-adhesive thereon that reacts with the first co-adhesive, and the timing layer is applied to the substrate by contacting the layer with the substrate to adhere the layer to the substrate.

18. The method of claim 2, wherein the timing layer has a first co-adhesive thereon and the substrate has a second co-adhesive thereon that reacts with the first co-adhesive, and the timing layer is applied to the substrate by contacting the layer with the substrate to adhere the layer to the substrate.

19. The method of claim 1, wherein the substrate has an adhesive thereon and the timing layer is applied to the substrate by contacting the layer with the substrate to adhere the layer to the substrate.

20. The method of claim 2, wherein the substrate has an adhesive thereon and the timing layer is applied to the substrate by contacting the layer with the substrate to adhere the layer to the substrate.

21. A method of continuously producing a plurality of printed and activated time dependent labels, comprising:

providing a web having a plurality of inked substrates thereon, each substrate having a migrating ink pattern printed on a surface of the substrate, providing a transfer printer having a first ribbon means for applying a timing layer through which the migrating ink bleeds after a first predetermined period of time, a second ribbon means for applying another timing layer through which the migrating ink bleeds after a second predetermined period of time that differs from the first predetermined period of time, and a third ribbon means for printing variable data, continuously feeding the web of inked substrates through the printer, wherein each inked substrate passes sequentially under the first ribbon means, the second ribbon means and the third ribbon means, activating the first ribbon means to apply the timing layer to a portion of the printed surface of each inked substrate thereunder to produce a coated portion of the substrate, activating the second ribbon means to apply the timing layer to another portion of the printed surface of each inked substrate thereunder to produce another coated portion of the substrate, and activating the second ribbon means to print the variable data information on a portion of the coated substrate thereunder, whereby a plurality of activated time dependent labels, each having variable data information printed thereon and two predetermined periods of times for expiration, are continuously produced.

22. A method of continuously producing a plurality of printed and activated time dependent labels, comprising:

providing a web having a plurality of inked substrates thereon, each substrate having a migrating ink pattern printed on a surface of the substrate, providing a transfer printer having a ribbon means for applying a timing layer through which the migrating ink bleeds after a predetermined period of time, and for printing variable data, continuously feeding the web of inked substrates through the printer, wherein the ribbon passes over each inked substrate, activating the ribbon to simultaneously apply the timing layer to a portion of the printed surface of the inked substrate thereunder to produce a coated substrate and to print the coated substrate with the variable data information, whereby a plurality of activated time dependent labels having variable data information printed thereon are continuously produced.

23. The method of claim 22, wherein the coated substrate is reverse printed with variable data.

* * * * *

UNITED STATES PATENT AND TRADEMARK OFFICE

CERTIFICATE OF CORRECTION

PATENT NO. : 6,916,130 B1
DATED : July 12, 2005
INVENTOR(S) : Holt et al.

It is certified that error appears in the above-identified patent and that said Letters Patent is hereby corrected as shown below:

Column 5,
Line 3, “p reprinted” should be -- preprinted --.

Column 6,
Line 2, “to” should be deleted.

Column 9,
Line 26, -- side -- should be inserted between “the opposite” and “of the Ribbon”.
Line 29, “printed” should be -- preprinted --.
Line 30, -- print -- should be inserted between “after the” and “head lifts”.

Signed and Sealed this

Twenty-seventh Day of December, 2005

JON W. DUDAS
*Director of the United States Patent and Trademark Office*